US005323726A

United States Patent [19]

Olsson

[11] Patent Number: 5,323,726

[45] Date of Patent: Jun. 28, 1994

[54] METHOD AND DEVICE FOR CONTROLLING A MULTI ELECTRODE SWEEP

[75] Inventor: Thord M. Olsson, Bjärred, Sweden

[73] Assignee: SA Marine AB, Landskorna, Sweden

[21] Appl. No.: 910,309

[22] PCT Filed: Jan. 22, 1991

[86] PCT No.: PCT/SE91/00039

§ 371 Date: Jul. 21, 1992

§ 102(e) Date: Jul. 21, 1992

[87] PCT Pub. No.: WO91/10587

PCT Pub. Date: Jul. 25, 1991

[30] Foreign Application Priority Data

Jan. 22, 1990 [SE] Sweden ..... 9000201

[51] Int. Cl.[5] ..... B63B 21/00

[52] U.S. Cl. ..... 114/221 R; 114/242; 102/402

[58] Field of Search ..... 114/221 R, 244, 242, 114/313, 322, 330, 312; 102/402, 407; 340/850, 851, 852

[56] References Cited

U.S. PATENT DOCUMENTS

| | | | |
|---|---|---|---|
| 2,397,209 | 3/1946 | Schaelchlin et al. | 114/221 |
| 2,937,611 | 5/1960 | Schaelchlin et al. | 114/221 R |
| 3,060,883 | 10/1962 | Herbst et al. | 114/221 |
| 3,707,913 | 1/1973 | Lee | 102/18 |
| 3,826,215 | 7/1974 | Dyjak | 114/221 R |
| 3,946,696 | 3/1976 | Lubnow | 114/221 R |
| 4,562,789 | 1/1986 | Bornhofft et al. | 114/221 R |
| 4,627,891 | 12/1986 | Gibbard | 204/1 R |
| 4,697,522 | 10/1987 | Groschupp et al. | 102/402 |

FOREIGN PATENT DOCUMENTS

| | | | |
|---|---|---|---|
| 0205887 | 5/1986 | European Pat. Off. | B63G 7/02 |
| 0338901 | 4/1989 | European Pat. Off. | B63G 7/06 |
| 0366522 | 10/1989 | European Pat. Off. | B63G 7/06 |
| 977801 | 7/1970 | Fed. Rep. of Germany | B63G 7/06 |
| 8903788 | 3/1989 | PCT Int'l Appl. | B63G 7/06 |

OTHER PUBLICATIONS

Mine Countermeasures at Defendory '86.

*Primary Examiner*—David M. Mitchell
*Assistant Examiner*—Stephen P. Avila
*Attorney, Agent, or Firm*—Joseph C. Mason, Jr.; Ronald E. Smith; Anders Hansson

[57] ABSTRACT

The invention relates to a method and a device for sweeping marine mines having a magnetic sensor by at least three electrodes (10, 11, 13) spaced apart and tractored by a vessel (12) and behind each other, the electrodes being provided with electric current from the vessel (12) for generating a magnetic field in the water surrounding the electrodes (10, 11, 13), each of the electrodes (10, 11, 13) separately being provided with electric current of individually adjustable strength. The invention is characterized by varying in time the current strength of the current fed to the electrodes between positive and negative limits with intermediate zero passages to separate the time for zero passage of the current to at least one of the electrodes (10, 11, 13) from the time for zero passage of the current to the rest of the electrodes (10, 11, 13).

10 Claims, 3 Drawing Sheets

METHOD AND DEVICE FOR CONTROLLING A MULTI ELECTRODE SWEEP

Figure 1:
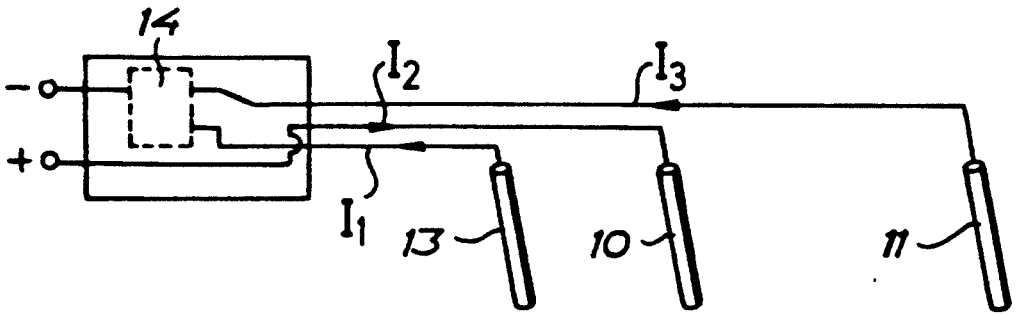
FIG. 1 Prior Art

The present invention relates to a method and a device for sweeping marine mines having a magnetic sensor using at least three electrodes which are spaced apart, and are tractored by a vessel and behind each other, said electrodes being provided with electric current from said vessel for generating a magnetic field in the water surrounding said electrodes, each of said electrodes separately being provided with electric current of an individually adjustable strength.

When sweeping marine mines having a magnetic sensor a magnetic field has to be generated, said magnetic field being sufficiently strong and sufficiently similar to a magnetic field generated by a vessel to be regarded by the mine as a vessel target, thereby detonating the mine. For the protection of the vessel carrying out the mine sweeping it is desirable to limit the magnetic field of such a strength to an area safely distanced from the mine sweeping vessel, so as to prevent a mine detonated by said magnetic field from damaging said mine sweeping vessel.

A sweeping operation must fulfil two primary demands. A first demand is to make mines having a low sensitivity detonating even if they are displaced a large distance in the transverse direction of the track of the vessel and thereby being actuated by a comparatively weak magnetic field from the sweep. A second demand is that mines having a high sensitivity shall not be triggered within a certain security zone surrounding the sweeping vessel. These claims are partially conflicting because a strong magnetic field required to achieve said first demand hampers the achievement of said second demand. Furthermore, the characteristics of the magnetic field generated by the sweep should be such that it is identified by the mine as a magnetic field generated by a target vessel, even if the mine is provided with means for analyzing surrounding magnetic fields.

The method of sweeping marine mines having a magnetic sensor by means of an electrode sweeping arrangement comprises the following steps. Two or more electrodes are placed in the water and tractored by one or several vessels. The electrodes are supplied with electric current from said tractoring vehicle, the current in the cables and through the water generating the desired magnetic field.

U.S. Pat. No. 2,937,611 discloses a system in sweeping marine mines by means of a plurality of vessels, each vessel being provided with a pair of electrodes. The system provides a pulsating magnetic field between the electrodes. U.S. Pat. No. 2,397,209 relates to a system in mine sweeping according to which a pulsating magnetic field is provided between two of the electrodes tractored by the vessel. A more complicated system in mine sweeping is disclosed in U.S. 3,946,696. The system comprises two electrodes, a controlled current generator, and a magnetic field sensor. There is also included a control system controlling the current through the electrodes dependant on the magnetic field in the vicinity of the mine sweeping vessel. By measuring the magnetic field adjacent to the mine sweeping vessel the desired safety of the mine sweeping vessel can be obtained. SE,A, 8704069-7 relates to a method and a device in sweeping marine mines having a magnetic sensor. At least three electrodes are tractored spaced apart behind a vessel and behind each other, and said electrodes separately are provided with electric current of individually adjustable strength from said vessel for generating a magnetic field in the water surrounding said electrodes.

Another simple constructive step to increase the protection of the mine sweeping vessel without any impairing of the desired mine sweeping capabilities is to extend the mine sweeping arrangement behind the vessel. However, practical problems in dealing with long cables limit the length of the mine sweeping arrangements.

The magnetic field from a vessel moving normally and passing a mine varies in each position by time and can be regarded as combined by components in three directions of the co-ordinates in space. In each direction the magnetic field varies in such a way that during some moments the value of said magnetic field is zero. The moment of these so-called zero passages do not coincide in said three directions, a fact which is used by "intelligent" mines to avoid firing caused by a mine sweeping arrangement as described above, said zero passages of said arrangements coinciding in said three directions.

An object of the present invention is to accomplish a method for sweeping marine mines which are fired magnetically, said method fulfilling the above described demands. The object is accomplished by providing said generated magnetic field propagation characteristics having a sufficiently weak magnetic field in the vicinity of the mine sweeping vessel and a magnetic field varying in time according to the steps set out in claim 1.

Figure 2:
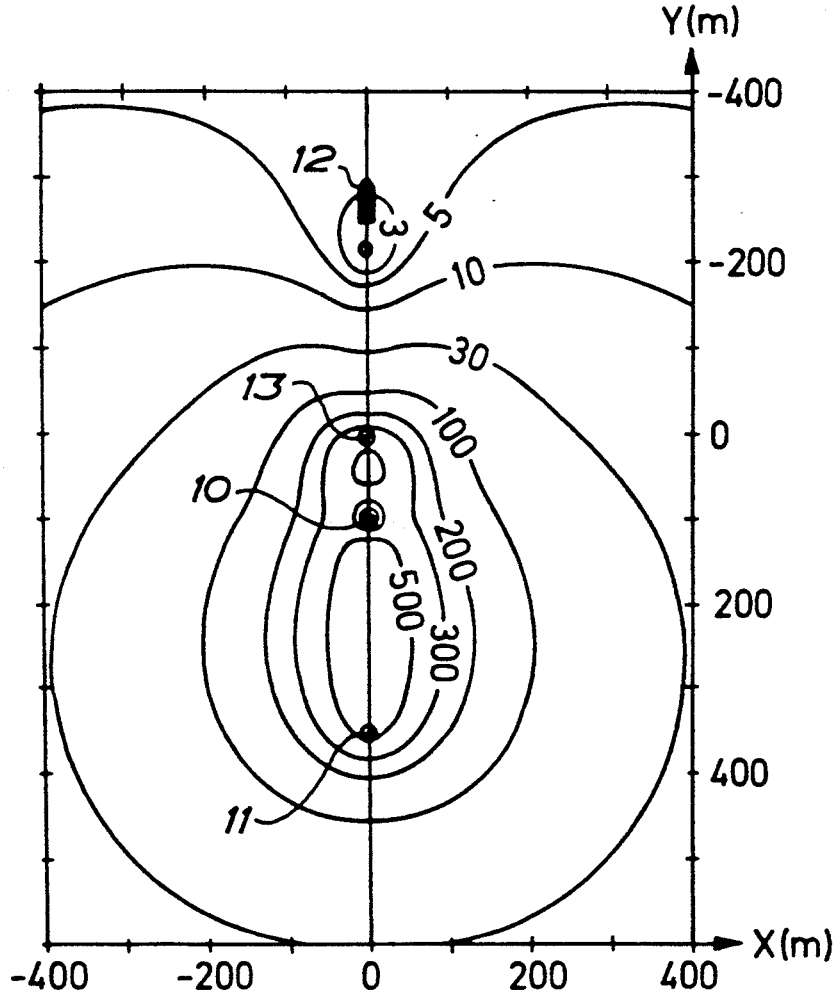
FIG. 2 Prior Art
Figure 3:
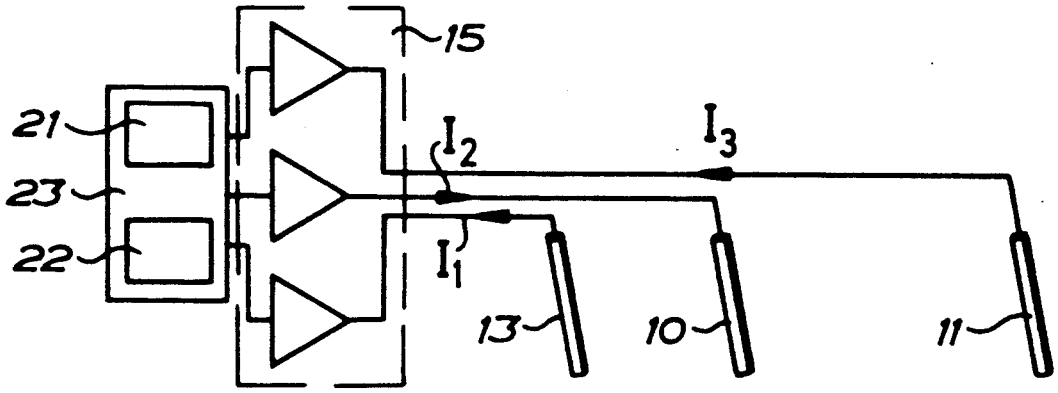
Figure 4:
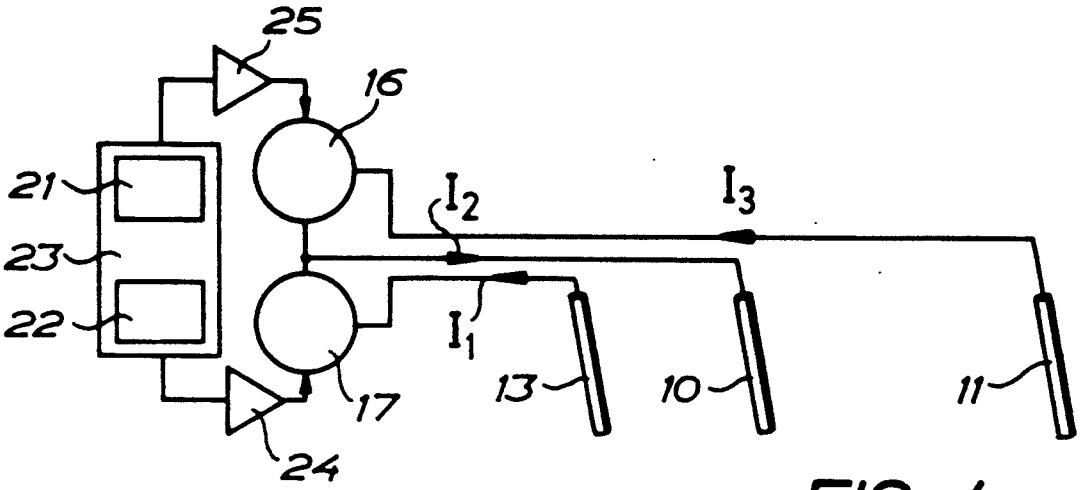
Figure 5:
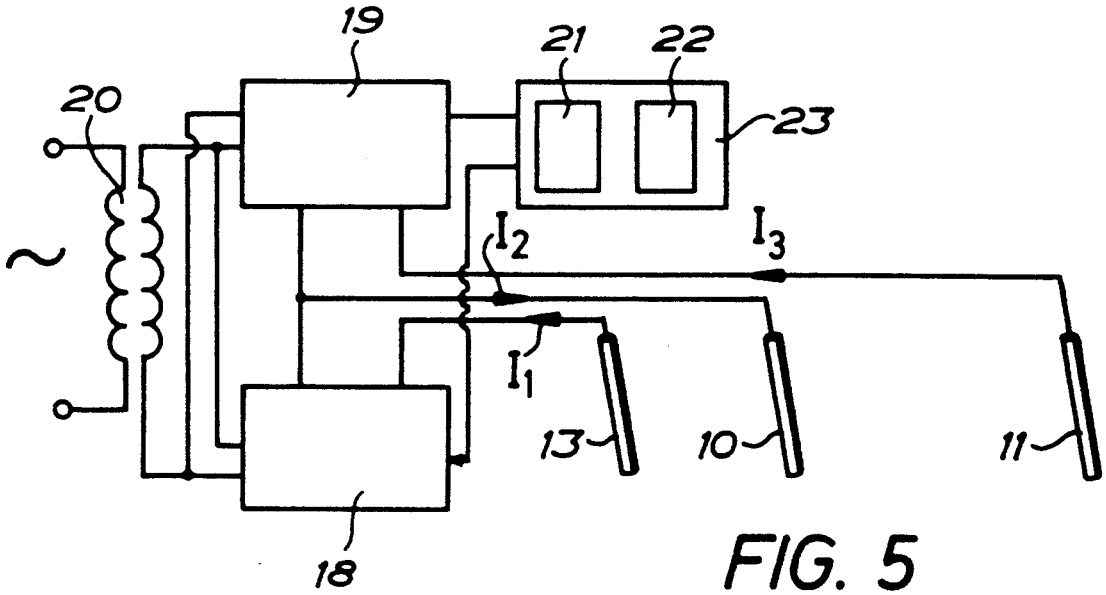
Figure 6:
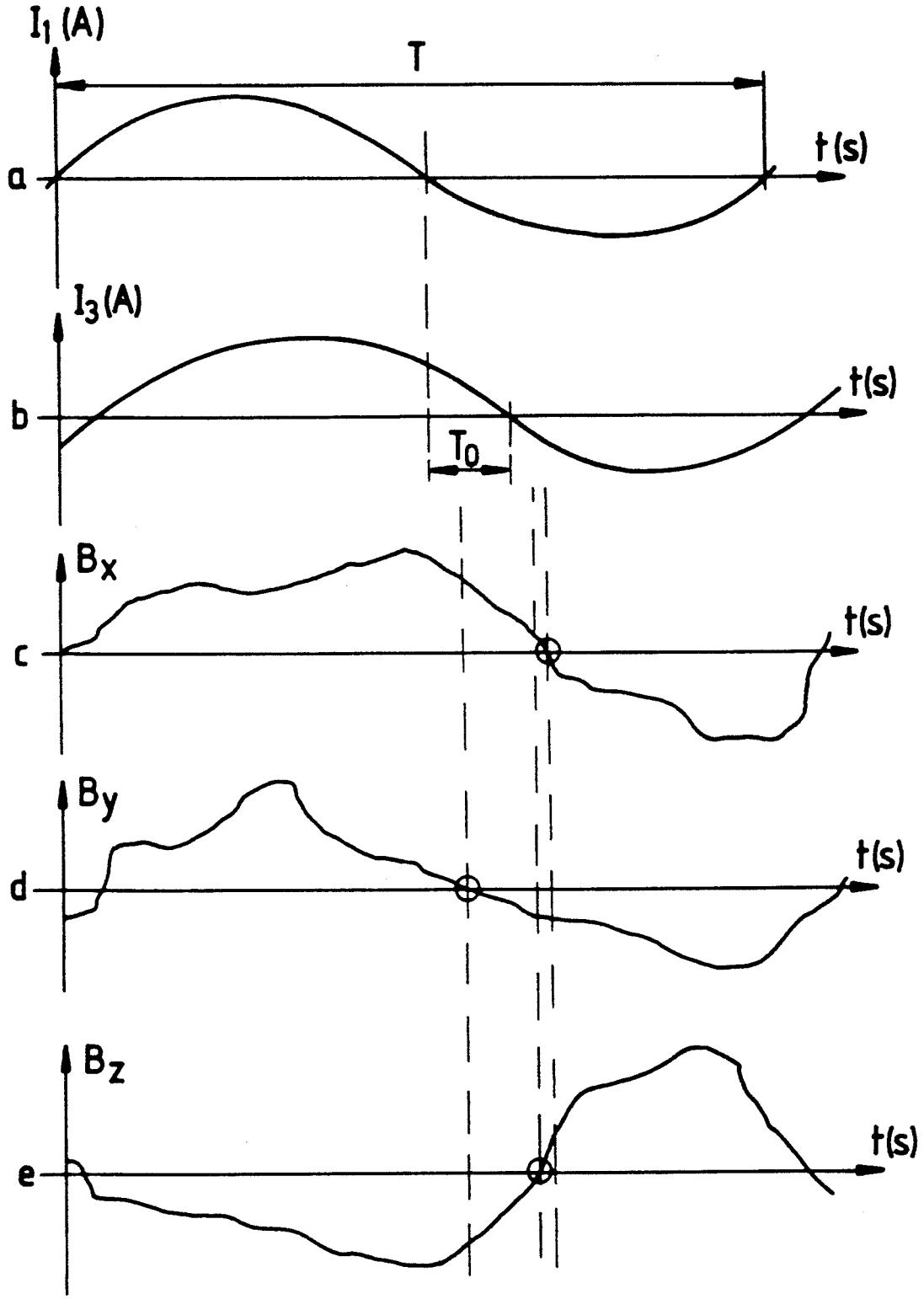

The invention will be described in more detail by means of an embodiment by reference to the accompanying drawings, in which FIG. 1 schematically shows a prior art three electrode sweep, FIG. 2 is a graph showing the field propagation of the three electrode sweep according to FIG. 1, FIG. 3 schematically shows a three electrode sweep according to the present invention, FIG. 4 schematically shows an embodiment of the three electrode sweep according to the present invention, FIG. 5 schematically shows an alternative embodiment of the three electrode sweep according to the present invention, FIG. 6*a* and FIG. 6*b* are graphs showing how the current in two electrodes varies in time, and FIG. 6*c–e* are graphs showing how the magnetic field varies in a position in the water in three directions in time.

As mentioned initially two partly contradictory demands have to be accomplished when sweeping mines. The magnetic field must be sufficiently strong to detonate mines in an area as large as possible. Using the mine sweep according to FIG. 1 a field propagation according to FIG. 2 can be accomplished. The mine sweep comprises a first electrode 10, a second electrode 11 and a third electrode 13. The current $I_1$ in said third electrode 13 and the current $I_3$ in the second electrode 11 are provided through a control and regulating unit 14 in turn being provided with electric current from a not shown power supply means. From FIG. 2 it is also clear how said electrodes are arranged on line behind a tractoring vessel 12, said third electrode 13 being arranged closest to said vessel, and said second electrode 11 being the last electrode. The lines of flux indicate the magnetic field in terms of nT. The width of an area covered by a magnetic field 100 nT strong is just above 400 m. Most mines will identify 100 nT as vessel target. The flux density allowed in the vicinity of the mine sweeping vessel varies depending on different factors, but should preferably be limited to 5 nT.

A crucial factor of the field propagation characteristic of a three electrode sweeping arrangement is the relationship between the current $I_1$ in the front electrode 13 and the current $I_3$ in the rear electrode 11, the distances between electrodes 10, 11 and 13, and the way the supplied current (and thereby also the magnetic field) varies in time. The distances between said electrodes are indicated in FIG. 2, and the relationship between $I_1$ and $I_3$ is 1, i.e. the strength and direction of current $I_1$ are equal to the strength and direction of current $I_3$. Each of the electrodes in the electrode sweeping arrangement is supplied separately with current, and the current in each electrode is controlled individually. To accomplish a magnetic sweep having the desired propagation characteristics the arrangement is first of all made with an appropriate consideration to the types of electrodes, the types of cables and the distances between the electrodes. Starting with these fundamentals the desired relationship between said current $I_1$ in said front electrode 13 and said current $I_3$ in said rear electrode 11 is determined. Said currents $I_1$, $I_2$ and $I_3$ are then adjusted to appropriate values so as to achieve the desired current relationship.

FIG. 3 shows an embodiment in principle of a device according to the invention. A power supply means 15 provides through separate means each electrode in the sweeping arrangement with an individually controllable current. To make possible a desired adjustment of the current supply to said electrodes with regard to time, and thereby also the magnetic field, in three space coordinate directions said power supply means 15 is operatively connected to a control means 23 comprising a central unit 21 and a memory unit 22 in which control data to said central unit for accomplishing any desired sequencies of varying magnetic field is stored. In a simple embodiment said control means 23 comprises a conventional mechanical timer, and in a further developed embodiment said central unit 21 comprises a computer and said memory unit comprises electronic memory chips and in some cases memories on magnetic media. The method according to the invention is described in more detail below with reference to FIG. 6.

FIG. 4 shows schematically an embodiment of the device according to the invention. The power supply means 15 comprises a first generator 16, providing said rear electrode 11 with the current $I_3$, and a second generator 17 providing said front electrode 13 with the current $I_1$. Said generators also comprise a common terminator which is connected to said center electrode 10 and through which said current $I_2$ is supplied. Control signals generated in said control means 23 are amplified in two driver means 24, 25. If AC generators are used rectifiers are provided between said generators and said electrodes. Controlled rectifiers are preferably used to make possible an adjustment of the current strength. The flow direction of currents can of course be reversed.

In the embodiment shown in FIG. 5 the power supply means comprising two controlled current rectifiers 18; 19 is connected to a generator existing on said vessel 12 through a transformer 20.

All electrodes and cables are of conventional type.

The method according to the invention will now be described in more detail with reference to FIG. 6*a–e*. FIG. 6*a* is an example of how the current $I_1$ in said front electrode 13 is varied in time by said control means 23, and FIG. 6*b* shows a corresponding variation of the current $I_3$ in said rear electrode 11. As is clear form FIG. 6*a* and FIG. 6*b* the zero passage of $I_3$ is displaced $T_0$ s in relation to the zero passage of $I_1$. The period of the variation of the current $I_1$ is referred to as T, and $T_0$ should preferably be less than or equal to T/4. The variation of said current $I_1$ and $I_3$ results in a variation also of the magnetic field. FIG. 6*c–e* show the variation of the magnetic field in an arbitrary position in the three space co-ordinate directions x, y and z. As a result of the displacement $T_0$ also the zero passages of the magnetic field in said three directions are displaced, and it is ensured that the generated magnetic field to a high extent corresponds to the magnetic field of a vessel.

I claim:

1. A method for sweeping marine mines of the type having a magnetic sensor, comprising the steps of:

spacing at least three electrodes apart from one another;

tractoring said at least three electrodes behind a vessel in longitudinally spaced relation to one another;

supplying each of said at least three electrodes with electric current from said vessel for generating a magnetic field in water surrounding said at least three electrodes;

separately supplying each of said at least three electrodes with electric current of individually adjustable strength;

varying said electric current in time between positive and negative limits with intermediate zero passages to separate the time for a zero passage of the electric current to at least one preselected electrode of said at least three electrodes from the time for a zero passage of the electric current to the other than said at least one preselected electrode.

2. The method according to claim 1, further comprising the step of supplying electric current to the electrode closest to said vessel in offset phase relation to the electric current to the electrode arranged most distant from said vessel.

3. The method according to claims 1 or 2, further comprising the step of varying the strength of the electric current while maintaining a predetermined relationship between the electric current to the electrode closest to said vessel and the electric current to the electrode arranged most distant from said vessel.

4. The method of claims 1 or 2, further comprising the step of setting the difference in time between zero passages of the strength of the current of the electrode closest to said vessel and the strength of the current to the electrode most distant from said vessel to a preselected time that is below one fourth of the time interval between two zero passages of one of the currents.

5. The method of claims 1 or 2, further comprising the steps of providing a first electrode, a second electrode and a third electrode in sequence behind said vessel substantially along a straight line, said first electrode arranged closest to said vessel, and adjusting the current of said first electrode and the current of said third electrode to a predetermined relationship considering the size of said electrodes and the distance therebetween, and adjusting the current of a center electrode to a value adequate to provide predetermined propagation characteristics of the magnetic field generated by said electrodes.

6. A vessel-towed device for sweeping marine mines of the type having a magnetic sensor, comprising:

at least three electrodes towed by said vessel in spaced, longitudinal alignment with one another and said vessel;

a power supply means arranged on said vessel for supplying current of individually adjustable strength to said electrodes;

said power supply means being connected to control means for time coordinated control of the current of the electrode closest to said vessel and to the electrode most distant from said vessel.

7. The device according to claim 6, wherein said power supply means includes two generators separately connected to said control means and said electrodes for supplying electric current to said electrodes.

8. The device according to claim 6, further comprising:

a transformer connected to a generator on said vessel;

said transformer forming a part of said power supply unit;

at least a first and a second controlled current rectifier, each of which has two output terminals;

a first output terminal of said first current rectifier being connected to a first electrode arranged closest to said vessel;

a second output terminal of said first current rectifier being connected to a first output terminal of said second current rectifier;

said first output terminal of said second current rectifier being connected to a second electrode arranged behind said first electrode;

a second output terminal of said second current rectifier being connected to a third electrode arranged behind said second electrode; and said current rectifiers being separately operatively connected to said control means.

9. The device according to claim 6, further comprising:

at least two DC current generators;

each of said generators having two output terminals;

a first output terminal of said first DC current generator being connected to a first electrode arranged closest to said vessel;

a second output terminal of said first DC current generator being connected to a first output terminal of said second DC current generator;

said first output terminal of said second DC current generator being connected to a second electrode arranged behind said first electrode;

a second output terminal of said second DC current generator being connected to a third electrode arranged behind said second electrode; and said DC current generators separately being operatively connected to said control means.

10. The device according to claims 6, 7, 8, or 9, further comprising:

said control means including a central unit;

a memory unit operatively connected to said central unit;

driver means operatively connected to said central unit; and said driver means being connected to said power supply means.

* * * * *